US005401136A

United States Patent [19]

Mark

[11] Patent Number: 5,401,136

[45] Date of Patent: Mar. 28, 1995

[54] WALL MOVER

[76] Inventor: Lawrence E. Mark, P.O. Box 190558, Miami Beach, Fla. 33119-0558

[21] Appl. No.: 198,309

[22] Filed: Feb. 18, 1994

[51] Int. Cl.[6] ..... B66F 9/06

[52] U.S. Cl. ..... 414/618; 254/134; 294/116

[58] Field of Search ..... 212/140; 414/618, 619, 414/11; 254/133 R, 134; 394/116

[56] References Cited

U.S. PATENT DOCUMENTS

| | | | |
|---|---|---|---|
| 1,520,047 | 12/1924 | Alden et al. | 212/140 |
| 1,710,096 | 4/1929 | Luce | 414/618 |
| 1,717,377 | 6/1929 | Forry | 414/618 |
| 1,854,966 | 4/1932 | Unwin | 414/618 |
| 1,964,119 | 6/1934 | Hendry | 212/140 |
| 2,496,600 | 2/1950 | Grigsby | 294/116 |
| 2,516,483 | 7/1950 | Parker | 254/133 R |
| 3,720,435 | 3/1973 | Leyn | 294/116 |
| 4,036,353 | 7/1977 | Suter | 294/116 |
| 4,239,443 | 12/1980 | Rysewyk | 414/618 |
| 4,394,106 | 7/1983 | Frees et al. | 414/11 |

FOREIGN PATENT DOCUMENTS

| | | | |
|---|---|---|---|
| 3320802 | 12/1984 | Germany | 414/618 |
| 671332 | 4/1952 | United Kingdom | 414/618 |

*Primary Examiner*—David A. Bucci
*Assistant Examiner*—Thomas J. Brahan

[57] ABSTRACT

Lift-clamping device mounted on a movable base for the lifting and transporting of vertically oriented materials. A hinged arm device controlled by an operator using a jack linked to an adjustable clamp mechanism provides a means for lift and support of materials to be transported.

4 Claims, 2 Drawing Sheets

WALL MOVER

BACKGROUND OF THE INVENTION

1. Field of the Invention

The present wall mover relates generally to the lifting and transporting of large vertically oriented crates, wall panels or other materials.

2. Related Art

A search of patent classes 280.47.13 and 280.47.34, and contemporary catalogs: *Grainger, Northern Hydraulics*, and *Dozier Equipent Iternational*, revealed no prior art.

Hand trucks and dollies for the transport of materials generally require the operator to lift the articles and place the dolly under the articles before transport is possible. Hand trucks and fork lifts usually must be placed in the side center portion of the article. Said position limits the view around the article to be moved and further requires space for transport larger than the largest dimension of the article.

OBJECTS AND ADVANTAGES OF THE INVENTION

It is therefore an object of the wall mover to provide a means for lifting and moving vertically oriented articles. It is a further object to provide a stable transport device for vertically oriented articles. It is yet another object to provide a means that is controllable by one person for the lifting of said articles. It is still another object to use the power of hydraulics to do work usually done manually.

These and other objects, features and advantages of the present wall mover will become apparent to one skilled in the art upon reading the following detailed description in view of the drawings.

Figure 1:
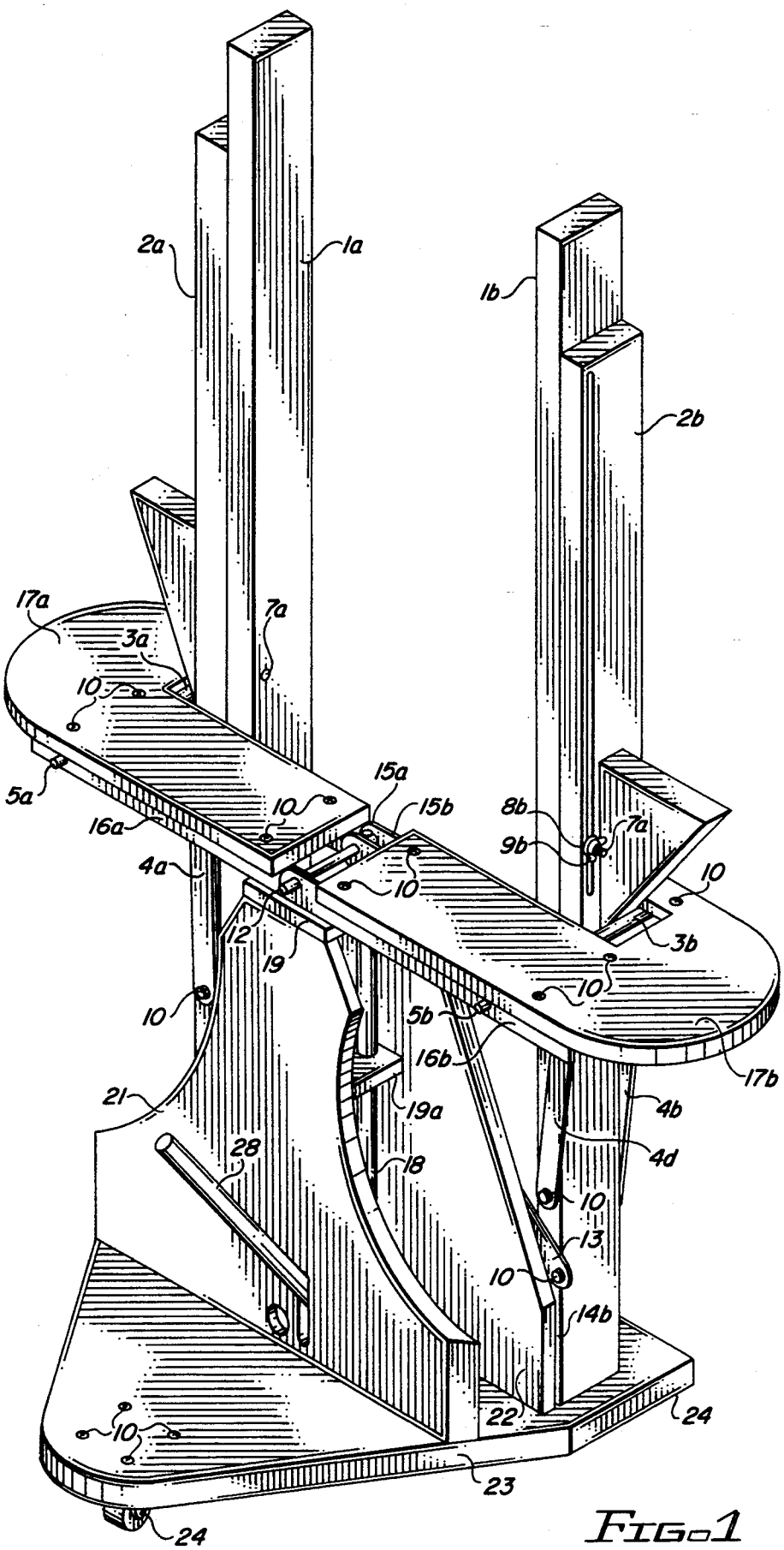
FIG. 1. is an isometric view of the assembled mover shown from the operator's position.

| Parts List | |
|---|---|
| 1a. Pad | 15a. U-channel |
| 1b. Pad | 15b. U-channel |
| 2a. Pressure pad | 16a. Angle iron |
| 2b. Pressure pad | 16b. Angle iron |
| 3a. Roller | 17a. Arm |
| 3b. Roller | 17b. Arm |
| 4a. Lift arm | 18. Lift rod |
| 4b. Lift arm | 19. Guide block |
| 4c. Lift arm | 19a. Guide block |
| 4d. Lift arm | 20. Brace |
| 5a. Rod | 21. Back |
| 5b. Rod | 22. Front |
| 6a. Pillow block | 23. Brace |
| 6b. Pillow block | 24. Swivel wheels |
| 7a. Carriage bolt | 25. Jack |
| 7b. Carriage bolt | 26. Jack handle |
| 8a. Washer | |
| 8b. Washer | |
| 9a. Wing nut | |
| 9b. Wing nut | |
| 10. Machine screw | |
| 11. Hex nut | |
| 12. Hinge pin | |
| 13. Stabilizer block | |
| 14a. Stabilizer arm | |
| 14b. Stabilizer arm | |

DETAILED DESCRIPTIONS OF THE DRAWINGS

The base assembly consists of a base 23 mounted on swivel wheels 24. The base supports a front 22. The front 22 supports a stabilizer block 13 and is attached to a brace 20 and supports guides 19 and 19*a*. The base supports a back 21 attached to the guide 19 and the brace 20. The front 22, back 21 and brace 20 provide support for a jack 25 operated by handle 28.

A hinge device consisting of two arms 17*a* and 17*b* and rods 5*a* and 5*b*. The hinge consists of two U-channels 15*a* and 15*b* connected by a hinge pin 12 connected to a lift rod 18. Rod 5*a* passes through angle iron 16*a*, U-channel 15*a*, lift arm 4*a* roller 3*a*, lift arm 4*c*, and pillow block 6*a*. Rod 5*b* passes through angle iron 16*b*, U-channel 15*b*, lift arm 4*d*, roller 3*b*, lift arm 4*b*, and pillow block 6*b*.

A lifting device consisting of pads 1*a* and 1*b* and pressure pads 2*a* and 2*b* is connected to lift arms 4*a*, 4*b*, 4*c*, and 4*d*. The pressure pads 2*a* and 2*b* are supported by bolts 7*a* and 7*b* with washers 8*a* and 8*b* and wing nuts 9*a* and 9*b*. The bolts 7*a* and 7*b*, washer 8*a* and 8*b*, and wing nuts 9*a* and 9*b* provide means for adjusting the distance between the pads 1*a* and 1*b*.

Stabilizer block 13 linked to pad 1*a* by stabilizer arm 14*a* and 1*b* by stabilizer arm 14*b* is attached to the front 22.

OPERATION OF WALL MOVER—FIGS. 1, 2

Figure 2:
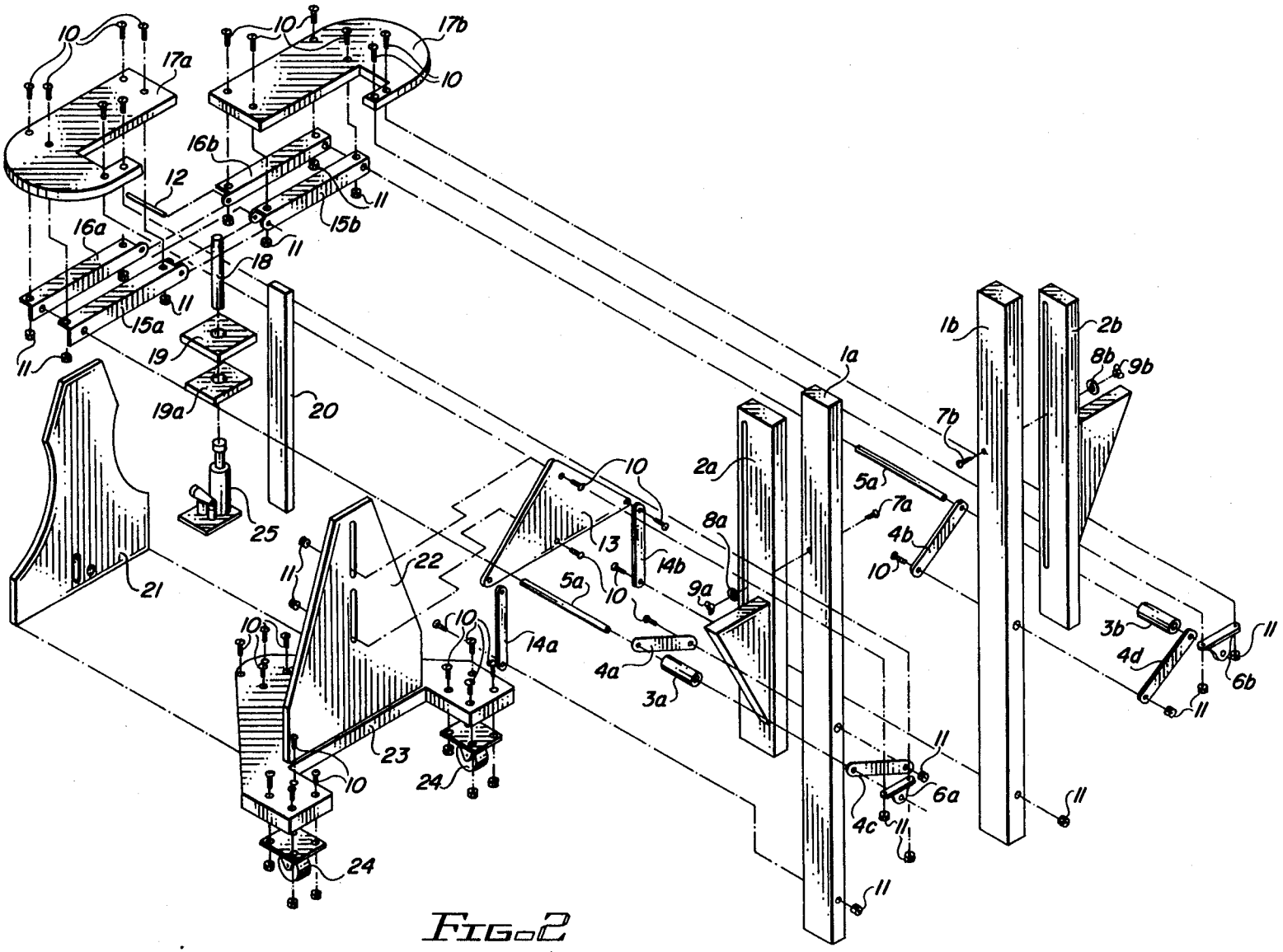
FIG. 2. is an exploded isometric view showing assembly of the parts.

The operation of the wall mover illustrated in FIGS. 1 and 2. The swivel wheels 24 allow an operator to move the device to the article to be lifted and transported. The operator stands behind the device and moves the device such that the article to be moved is roughly centered between pads 1*a* and 1*b*. The operator loosens wing nuts 9*a*,9*b* and manually lifts pads 1*a*,1*b* to the sides of the article to be moved. Pressure pads 2*a*,2*b* are lowered between pads 1*a*,1*b* and rollers 3*a*,3*b*. Wing nuts 9*a*,9*b* are tightened finger tight.

Operation of the jack 25 controls lift rod 18 and raises or lowers hinge pin 12. This action closes arms 17*a*,17*b*. Closure pressure is exerted along U-channels 15*a*,15*b* pulling rods 5*a*,5*b* against pressure pads 2*a*,2*b*. When the closure pressure is sufficient, lift arms 4*a*,4*b*,4*c*,4*d* attached to pads 1*a*,1*b* will lift article to be moved. To provide increased lifting pressure angle iron 16*a*,16*b* parallels U-channels 15*a*,15*b*.

Stabilizer arms 14*a*,14*b* attached to pads 1*a*,1*b* and stabilizer block 13 keep the article vertical, but allow for lift in vertical direction.

Height of lift of the article to be moved is controlled by the action of the jack. When the desired height is obtained, the article may be transported to another location.

To release pressure on pads 1*a*,1*b* and unload an article from the wall mover slowly lower the jack 25. As the jack 25 is lowered the article will settle to the floor and continued lowering of the jack will release the pressure from the pads 1*a*,1*b*. Once article is firmly settled on the floor, loosen the wing nuts 9*a*,9*b* and manually raise pressure pads 2*a*,2*b*. Pads 1*a*,1*b* will swivel to the open position on stabilizer arms 14*a*,14*b*.

CONCLUSION, RAMIFICATIONS AND SCOPE

Therefore, the reader will see that the wall mover of this invention can be used to lift and transport large vertically oriented articles. Furthermore, the wall mover has additional advantages in diverse fields. For example, the moving and placing of flats in stage construction, the temporary placing of wall surfaces in galleries, or during construction of large rooms as in convention centers or trade shows. Furthermore, the compact nature of the wall mover makes it useful in close quarters; unloading large crates from trucks, moving materials in narrow halls, etc. Furthermore, operator control of the move from one end of a large object enhances visual control during transport.

The descriptions given above do not limit sizes, or loads and should be used as providing illustration of the preferred embodiment of the wall mover. For example the base may be square or any other shape. The height may be any height desired. The jack may be any type that is convenient for the operator. The materials may be varied as long as they provide the necessary strength for the proposed use.

Thus the scope of the wall mover should be determined by the appended claims and their legal equivalents, rather than by the example given.

I claim:

1. A portable lifting device for raising and transporting a load, said device comprising:

a portable base with wheels;

a linear actuator having upper and lower ends, said lower end being mounted on said base as to have the linear actuator extensible vertically;

a pair of arms extending outwardly from said linear actuator, said arms each having a proximal end with a pivot connection mounting said arms to said upper end of said linear actuator, said arms each having a distal end formed with an aperture, said apertures each defining a bearing surface; and a pair of vertically extending elongated pad means supported on said base, each of said pad means having an inner surface for engaging the load and an outer surface defining a wedge surface for engagement with one of said bearing surfaces of said arm apertures;

whereby extension of said linear actuator raises said proximal ends of said arms and causes sliding engagement of said bearing surfaces with said wedge surfaces to move said pad means inwardly towards each other until the load is clamped, and further extension of said linear actuator raises the load.

2. The lifting device as set forth in claim 1 wherein said linear actuator is a jack.

3. The lifting device as set forth in claim 1 wherein said bearing surfaces comprise rollers.

4. The lifting device as set forth in claim 1 wherein said pair of pad means each comprises an inner pad, an outer pad, and adjustment means for fixing their relative heights.

* * * * *